US009799939B2

(12) United States Patent
Kikuda et al.

(10) Patent No.: US 9,799,939 B2
(45) Date of Patent: Oct. 24, 2017

(54) FILTERING DEVICE AND METHOD FOR ADJUSTING FILTER CHARACTERISTIC

(71) Applicant: Murata Manufacturing Co., Ltd., Nagaokakyo-shi, Kyoto-fu (JP)

(72) Inventors: Masayuki Kikuda, Nagaokakyo (JP); Hitoshi Tada, Nagaokakyo (JP); Yoshiki Yamada, Nagaokakyo (JP); Takahiro Okada, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 77 days.

(21) Appl. No.: 14/790,405

(22) Filed: Jul. 2, 2015

(65) Prior Publication Data

US 2016/0006096 A1 Jan. 7, 2016

(30) Foreign Application Priority Data

Jul. 7, 2014 (JP) ..... 2014-139241
Apr. 3, 2015 (JP) ..... 2015-076522

(51) Int. Cl.
*H01P 3/06* (2006.01)
*H01P 1/205* (2006.01)

(52) U.S. Cl.
CPC ..... *H01P 1/2056* (2013.01)

(58) Field of Classification Search
CPC .... H01P 1/2084; H01P 1/202; H01P 1/20318; H01P 1/2053; H01P 7/10; H01P 1/2056
USPC ..... 333/206, 207, 219.1
See application file for complete search history.

(56) References Cited

U.S. PATENT DOCUMENTS 4,464,640 A * 8/1984 Nishikawa ..... H01P 1/2056 333/202
5,412,359 A * 5/1995 Kazama ..... H01P 1/2053 333/134
5,867,076 A * 2/1999 Tada ..... H01P 7/04 333/206
6,400,239 B1 * 6/2002 Chun ..... H01P 1/2056 333/202

FOREIGN PATENT DOCUMENTS

CN 102738552 A 10/2012
JP H11-340713 A 12/1999

* cited by examiner

*Primary Examiner* — Robert Pascal
*Assistant Examiner* — Kimberly Glenn
(74) *Attorney, Agent, or Firm* — Arent Fox LLP

(57) ABSTRACT

A filtering device includes at least one dielectric resonant element, which includes a dielectric block, an outer conductor, and an inner conductor, a terminal disposed in a through hole of the dielectric resonant element from a front surface, a plate-shaped circuit element electrically coupled with the at least one dielectric resonant element via the terminal, and a substrate on which the at last one dielectric resonant element and the plate-shaped circuit element are mounted. The outer conductor is disposed so as to cover the back surface besides the peripheral surface of the dielectric block. The first end surface of the dielectric block includes a first electrode-free portion that electrically isolates the inner conductor from the outer conductor, and a second electrode-free portion that electrically isolates the inner conductor from the outer conductor.

17 Claims, 9 Drawing Sheets

FIG. 4A
| | λ/4 RESONATOR | λ/2 RESONATOR |
|---|---|---|
| Ce (pF) | 0.150 | 0.167 |
| Ck (pF) | 0.117 | 0.202 |
FIG. 4B
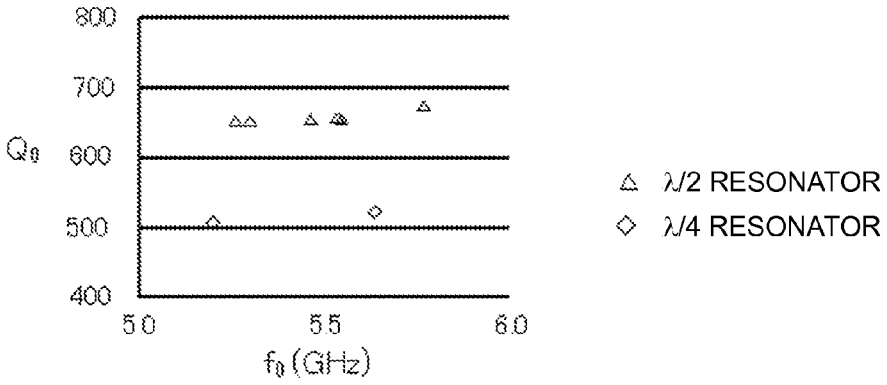
FIG. 4C
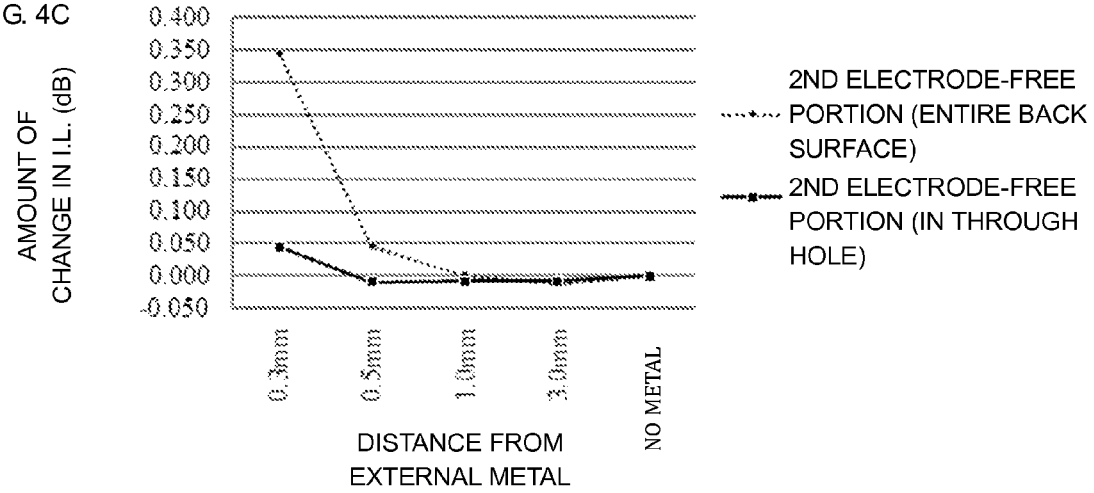

FILTERING DEVICE AND METHOD FOR ADJUSTING FILTER CHARACTERISTIC

CROSS REFERENCE TO RELATED APPLICATIONS

The present application claims priority to Japanese Patent Application No. 2014-139241, filed Jul. 7, 2014, and Japanese Patent Application No. 2015-076522, filed Apr. 3, 2015, the entire contents of each of which are incorporated herein by reference.

FIELD OF THE INVENTION

The present invention relates to a filtering device including a dielectric resonant element and a method for adjusting the characteristics of the filtering device.

BACKGROUND OF THE INVENTION

A dielectric resonant element includes a dielectric block having a through hole, an outer conductor disposed on the outer surface of the dielectric block, and an inner conductor disposed on the inner surface of the through hole. A dielectric resonant element constitutes a λ/4 resonator, in which the inner conductor and the outer conductor are separated from each other at one end of the through hole and short-circuited at the other end of the through hole, or a λ/2 resonator, in which the inner conductor and the outer conductor are separated from each other at both ends of the through hole. The dielectric resonant element has a single-pair configuration that has only one pair of a through hole and an inner conductor (a dielectric resonant element having this configuration is hereinafter referred to as a discrete resonant element) or a multi-pair configuration that has multiple pairs of a through hole and an inner conductor (a dielectric resonant element having this configuration is hereinafter referred to as a bulk resonant element).

In a discrete resonant element constituting a λ/4 resonator, the Q factor may decrease due to concentration of electric currents around a short-circuited end at which the inner conductor and the outer conductor are short-circuited. In order to minimize concentration of electric currents, some discrete resonant elements have their outer conductors thickened around their short-circuited ends (see, for example, Japanese Unexamined Patent Application Publication No. 11-340713).

In the case where a filtering device includes a bulk resonant element having a multi-pair configuration, typically, resonators are coupled together using mutual capacitance between the inner conductors that occurs inside the dielectric blocks. On the other hand, in the case where a filtering device includes a discrete resonant element having a single-pair configuration, resonators are coupled together by inserting terminals from open ends into the through holes and by connecting together, using the terminals, the inner conductors and other circuit elements such as capacitive elements.

As described above, when a filtering device includes dielectric resonant elements and terminals, desired filter characteristics can be easily resulted from combining appropriate circuit elements. Such a filtering device can thus be designed highly flexibly.

Typically, a filtering device including a dielectric resonant element and a terminal has an electrode-free portion for separating the inner conductor and the outer conductor from each other on an end surface of the dielectric resonant element so as to prevent the inner conductor and the outer conductor from being electrically continuous with each other near the open end through a terminal or solder connected to the terminal. In such a filtering device, a portion of the surface of the dielectric resonant element is exposed without being covered with the outer conductor and thus the discrete resonant element is subject to external influences. Such a filtering device thus typically includes a shield member disposed so as to cover the discrete resonant element. In addition, in order to allow partial trimming of the outer conductor or the inner conductor of the discrete resonant element, the shield member is typically disposed in such a manner as to leave part of the discrete resonant element exposed.

In recent years, the radio communication band has been shifting to higher frequencies. Such a shift encourages the use of a frequency band unused thus far, such as a 5-GHz band, for radio communications. Accordingly, filtering devices including a dielectric resonant element and a terminal have been required to be adapted for higher frequency bands.

However, in order for filtering devices including a dielectric resonant element and a terminal to be adapted for higher frequency bands, the dielectric resonant elements are required to have a much smaller size than existing elements. Reduction of the size of the dielectric resonant elements renders it difficult to form circuit elements and as a result to adapt the filtering devices to higher frequency bands.

For example, if discrete resonant elements constituting λ/4 resonators according to Japanese Unexamined Patent Application Publication No. 11-340713 are reduced in size to a large extent, the capacitance required as a coupling capacitance for coupling the dielectric resonant elements together is significantly reduced. In order to fulfill a required coupling capacitance, the electrode area of a circuit element (capacitive element) connected to the terminal is required to be miniaturized or a drastic design change such as use of special material is required. Such a requirement hampers forming of a circuit element (capacitive element) into a general or simple configuration.

For example, significant size reduction of a discrete resonant element constituting a λ/4 resonator according to Japanese Unexamined Patent Application Publication No. 11-340713 requires size reduction of the shield member. This size reduction renders it difficult to leave the dielectric resonant element to be exposed, thereby impeding an operation of adjusting the filter characteristics of the filtering device.

SUMMARY OF THE INVENTION

Accordingly, it is an object of the present invention to provide a filtering device that includes a circuit element having a general or simple configuration when adapted to a frequency band higher than a frequency band used thus far, and that can be prevented from being subject to external influences due to a shift to high frequencies. Another object of the present invention is to provide a method for adjusting the characteristics of the filtering device.

A filtering device according to an aspect of the invention is a filtering device that includes a at least one dielectric resonant element including a dielectric block, an outer conductor, and an inner conductor, the dielectric block having the first end surface, the second end surface, an outer peripheral surface, and a through hole that extends from the first end surface to the second end surface, the outer conductor disposed on the outer peripheral surface and the second end surface, and the inner conductor disposed on an inner surface of the through hole; a terminal disposed in the through hole of the at least one dielectric resonant element from the first end surface; a circuit element electrically coupled with the at least one dielectric resonant element via the terminal; and a substrate on which the at least one dielectric resonant element and the circuit element are mounted. The first end surface of the dielectric block includes a first electrode-free portion that electrically isolates the inner conductor from the outer conductor, and wherein at least one of the through hole and the second end surface of the dielectric block includes a second electrode-free portion that electrically isolates the inner conductor from the outer conductor.

In this configuration, the first electrode-free portion is disposed on the first end surface of the dielectric resonant element from which the terminal is inserted into the dielectric resonant element. Thus, appropriate circuit elements can be connected using the terminal while the terminal is prevented from short-circuiting the inner conductor and the outer conductor. This configuration can thus easily attain desired filter characteristics. In addition, the second electrode-free portion is disposed in the through hole or on the second end surface. Thus, the dielectric resonant element can constitute a $\lambda/2$ resonator. A $\lambda/2$ resonator is allowed to have a dielectric block of a size approximately two times as large as the size of a $\lambda/4$ resonator so as to resonate at the same resonance frequency as a $\lambda/4$ resonator. In addition, a $\lambda/2$ resonator requires a larger coupling capacitance than a $\lambda/4$ resonator to resonate at the same resonance frequency as a $\lambda/4$ resonator. Thus, even when a filtering device is adapted for a frequency band higher than a frequency band used thus far, a circuit element such as a capacitive element can be formed into a general or simple configuration. In addition, the outer conductor and the inner conductor are completely separated from each other in a $\lambda/2$ resonator. Thus, electric currents can be prevented from concentrating in the outer conductor, whereby a $\lambda/2$ resonator is allowed to have a higher Q factor than a $\lambda/4$ resonator.

Besides, this configuration allows the position of the dielectric resonant element to be changed with an adjustment of the amount by which the terminal is inserted into the dielectric resonant element. Thus, the filtering device can be rendered resistant to external influences by appropriately positioning the dielectric resonant element. Moreover, the filtering device can be rendered resistant to external influences on the second end surface side even when the second electrode-free portion is disposed on the second end surface of the dielectric resonant element since the outer conductor is disposed on the second end surface of the dielectric resonant element.

Preferably, at least part of the second electrode-free portion according to an embodiment of the invention is disposed in the through hole. This configuration can prevent the inner conductor from being exposed through the second end surface, whereby the filtering device can become resistant to external influences on the second end surface. Adjusting the shape, including the width or the position, of the second electrode-free portion inside the through hole enables an adjustment of the length of the inner conductor (resonator length). As described above, adjusting the amount by which the terminal is inserted into the dielectric resonant element changes the resonator length of the dielectric resonant element. Here, by adjusting the amount by which the terminal is inserted into the dielectric resonant element as well as the position of the second electrode-free portion, the position of the dielectric resonant element is appropriately determined while an appropriate resonator length is attained. Thus, the filtering device can become resistant to external influences.

Preferably, a filtering device according to an aspect of the invention further includes a shield member configured to cover the at least first end surface of the at least one dielectric resonant element. Thus, the filtering device can become resistant to external influences on the first end surface side.

Preferably, the shield member according to an aspect of the invention does not cover at least a portion of the second end surface side of the at least one dielectric resonant element. This configuration allows the characteristics of the dielectric resonant element to be adjusted by adjusting the amount by which the terminal is inserted into the dielectric resonant element, by adjusting the shape of the second electrode-free portion, or by trimming the second end surface of the dielectric resonant element.

Preferably, the shield member according to an aspect of the invention does not cover at least the portion of an end portion of the dielectric resonant element on the first end surface side of the at least one dielectric resonant element. This configuration allows the characteristics of the dielectric resonant element to be adjusted by adjusting the amount by which the terminal is inserted into the dielectric resonant element or by trimming the first end surface of the dielectric resonant element.

The dielectric resonant element according to an aspect of the invention may include a trimmed mark is disposed only on the first end surface of the dielectric block. This configuration prevents the area of the second end surface covered with the outer conductor from decreasing due to the existence of the trimmed mark. Thus, the filtering device can become resistant to external influences on the second end surface side.

The dielectric resonant element according to an aspect of the invention may include a trimmed mark is disposed only on the second end surface of the dielectric block. This configuration allows the shield member to dispense with a cavity that allows a portion of the shield member on the first end surface side of the dielectric resonant element to be exposed. Thus, the filtering device can become resistant to external influences on the first end surface side.

The dielectric resonant element according to an aspect of the invention may include a trimmed mark on the outer peripheral surface. Specifically, it is desirable that the trimmed mark be positioned in the outer peripheral surface between the first end surface and the second end surface of the dielectric block. In this case, the adjustment sensitivity of the resonator length or the resonance frequency can be higher than in the case where the first end surface or the second end surface is trimmed, so that the resonator length or the resonance frequency can be adjusted to a large extent. Thus, after the resonance frequency is adjusted to a large extent by trimming the outer peripheral surface, the resonance frequency can be finely adjusted by trimming the first end surface or the second end surface.

Preferably, the circuit element according to an aspect of the invention includes a plate-shaped circuit element that is in contact with the terminal and the substrate and that has a thickness substantially equal to a distance between the terminal. Thus, the configuration can be simplified since the circuit element connected to the dielectric resonant element also serves as a connector between the terminal and the substrate. When the dielectric resonant element is adapted for a higher frequency band, the coupling capacitance required by the dielectric resonant element does not decrease significantly. Thus, even such a plate-shaped circuit element can attain a required coupling capacitance.

Preferably, the at least one dielectric resonant element according to an aspect of the invention includes only one pair of the through hole and the inner conductor, that is, the dielectric resonant element is a so-called discrete resonant element. Typical dielectric resonant elements resonate in a transverse electromagnetic mode (TEM mode) but also resonate in a transverse electric mode (TE mode) as a spurious mode. The resonance frequency in the TE mode is characteristically determined in accordance with the external size of the dielectric block. In order to attain the band pass filter characteristics, a bulk resonant element having a multi-pair configuration is apt to reduce its filter characteristics due to the resonance frequency in the TE mode approaching the pass band. In contrast, in order for a discrete resonant element having a single-pair configuration to attain its band pass filter characteristics, the resonance frequency in the TE mode is likely to keep away from the pass band. Thus, compared to a bulk resonant element having a multi-pair configuration, a discrete resonant element is characteristically less likely to reduce its filter characteristics in the TE mode.

A method for adjusting filter characteristics according to an aspect of the invention includes subjecting the filtering device to an adjustment of an amount by which the terminal is inserted into the dielectric resonant element and an adjustment of a shape of the second electrode-free portion. This method enables appropriate setting of the resonator length of the dielectric resonant element and an adjustment of positioning of the dielectric resonant element. Thus, the filtering device can become resistant to external influences.

Preferably, the method for adjusting filter characteristics according to an aspect of the invention further includes trimming at least one of the first end surface and the second end surface, whereby the resonator length of the dielectric resonant element can be adjusted and desired filter characteristics can be easily obtained.

According to some aspects of the invention, the filtering device can be easily adapted for a high frequency band and the filtering device can be prevented from being subject to external influences due to a shift to a high frequency band.

Other features, elements, characteristics and advantages of the present invention will become more apparent from the following detailed description of preferred embodiments of the present invention (with reference to the attached drawings).

BRIEF DESCRIPTION OF THE DRAWINGS

FIGS. 4A to 4C are a table and graphs of various characteristics of the filtering device according to the first embodiment;

DETAILED DESCRIPTION OF THE PREFERRED EMBODIMENTS

Now, multiple embodiments of the invention are described below as examples using filtering devices having band pass filter characteristics. The invention can be also embodied as filtering devices having other characteristics such as band elimination filter characteristics (BEF characteristics), high-pass filter characteristics (HPF characteristics), or low-pass filter characteristics (LPF characteristics), besides filtering devices having band pass filter characteristics. The embodiments described below are mere examples and some components according to different embodiments may be naturally switched or combined.

First Embodiment

Figure 1:
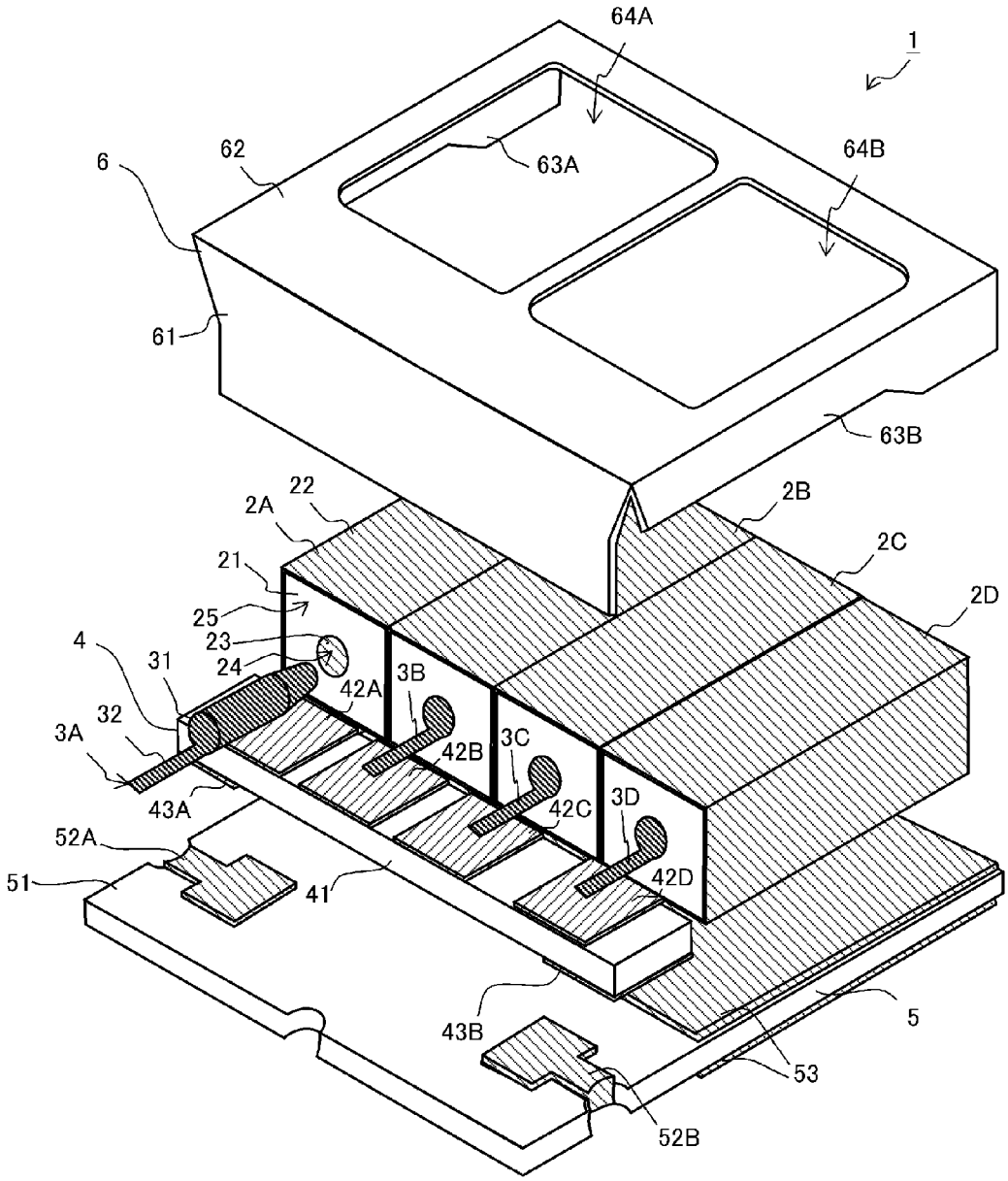
FIG. 1 is an exploded perspective view of a filtering device according to a first embodiment when viewed from the front surface.
Figure 2:
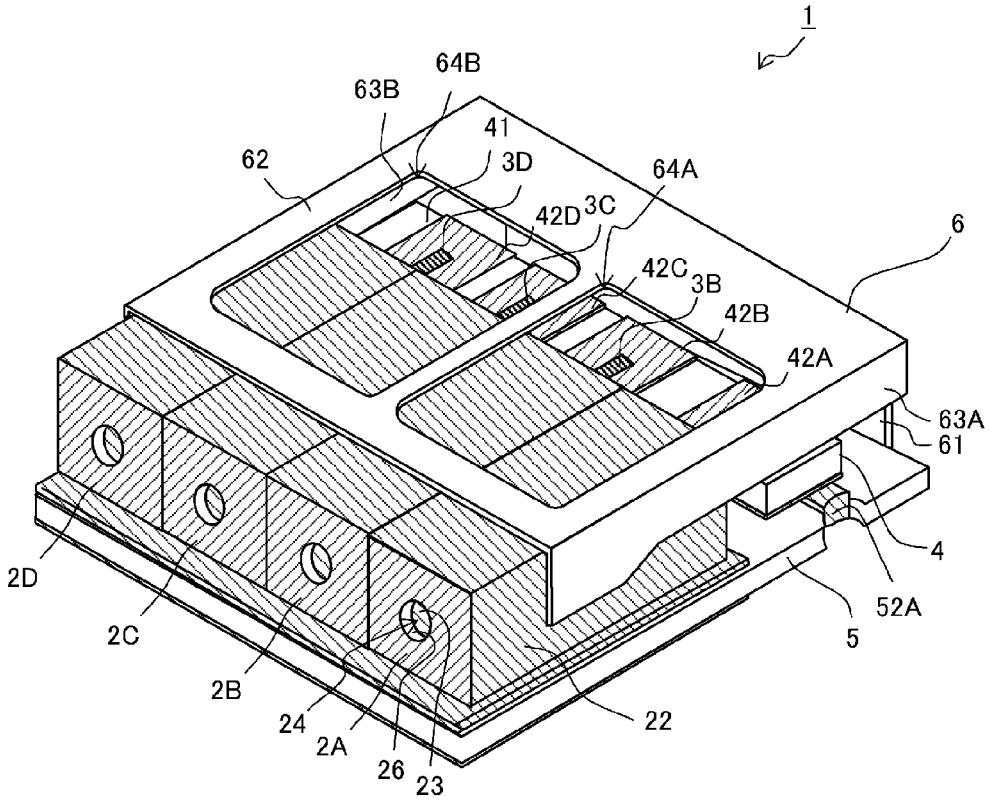
FIG. 2 is an external perspective view of the filtering device according to the first embodiment when viewed from the back surface.

FIG. 1 is an exploded perspective view of a filtering device 1 according to a first embodiment when exploded and viewed from the front surface. FIG. 2 is an external perspective view of the filtering device according to the first embodiment when viewed from the back surface.

The filtering device 1 according to the first embodiment includes dielectric resonant elements 2A, 2B, 2C, and 2D, terminals 3A, 3B, 3C, and 3D, a plate-shaped circuit element 4, a substrate 5, and a shield member 6.

The dielectric resonant elements 2A to 2D are mounted on an upper surface of the substrate 5. The dielectric resonant elements 2A to 2D are arranged in order from the left surface side to the right surface side of the substrate 5. The dielectric resonant elements 2A to 2D are each a rectangular parallelepiped having a square front surface and a square back surface, and each extend lengthwise from the front surface to the back surface. The dielectric resonant elements 2A to 2D each include a dielectric block 21, an outer conductor 22, and an inner conductor 23.

The dielectric block 21 is a cuboid made of a dielectric material such as low temperature co-fired ceramics (LTCC). The dielectric block 21 has a through hole 24, which extends from the front surface to the back surface of the dielectric block 21 through the dielectric block 21. The front surface of the dielectric block 21 corresponds to a "first end surface" described in claims. The back surface of the dielectric block 21 corresponds to a "second end surface" described in claims. The upper surface, the lower surface, the right side surface, and the left side surface of the dielectric block 21 each correspond to a "peripheral surface" described in claims.

The outer conductor 22 is disposed so as to cover the entireties of five surfaces of the outer surfaces of the dielectric block 21 except the front surface.

The inner conductor 23 is disposed so as to cover an inner surface of the through hole 24.

Each of the dielectric resonant elements 2A to 2D includes electrode-free portions 25 and 26 that separate the inner conductor 23 and the outer conductor 22 from each other. As illustrated in FIG. 1, the electrode-free portion 25 is disposed over the entire front surface of the dielectric block 21. As illustrated in FIG. 2, the electrode-free portion 26 is disposed at an end portion of the through hole 24 on the back surface side. The electrode-free portion 25 corresponds to a "first electrode-free portion" described in claims. The electrode-free portion 26 corresponds to a "second electrode-free portion" described in claims. By appropriately adjusting the width or the position of the electrode-free portion 26 inside the through hole 24, the resonator length (the length of the inner conductor 23) of each of the dielectric resonant elements 2A to 2D can be changed.

The terminal 3A is inserted into the through hole 24 of the dielectric resonant element 2A from the front surface (from the electrode-free portion 25). The terminal 3B is inserted into the through hole 24 of the dielectric resonant element 2B from the front surface (from the electrode-free portion 25). The terminal 3C is inserted into the through hole 24 of the dielectric resonant element 2C from the front surface (from the electrode-free portion 25). The terminal 3D is inserted into the through hole 24 of the dielectric resonant element 2D from the front surface (from the electrode-free portion 25). By appropriately adjusting the amount by which the terminals 3A to 3D are respectively inserted into the dielectric resonant elements 2A to 2D, the resonator lengths of the dielectric resonant elements 2A to 2D can be changed and the positions of the dielectric resonant elements 2A to 2D in the direction connecting the front surface to the back surface of each of the dielectric resonant elements 2A to 2D can be changed.

The terminals 3A to 3D are made of a material such as copper or aluminum. The terminals 3A to 3D are each formed from an integral metal plate and each include a tube portion 31 and a tongue portion 32. The tube portion 31 is formed by bending a metal plate into a tube. The tongue portion 32 is a portion shaped like a tongue and extends in the axial direction of the tube portion 31 from the tube portion 31. The tube portion 31 is inserted into the through hole 24 of the dielectric block 21 and coupled to the inner conductor 23 disposed inside the through hole 24 by a coupling method such as soldering. The tongue portion 32 protrudes beyond the front surface of the dielectric block 21 from the through hole 24.

As described above, the electrode-free portion 25 extends over the entire front surface of each of the dielectric resonant elements 2A to 2D. Although each of the terminals 3A to 3D is inserted into the through hole 24 of the corresponding one of the dielectric resonant elements 2A to 2D from the front surface, the inner conductor 23 and the outer conductor 22 can be prevented from being electrically continuous with each other through the corresponding one of the terminals 3A to 3D or solder.

The plate-shaped circuit element 4 is mounted on the upper surface of the substrate 5. The plate-shaped circuit element 4 is disposed adjacent to the front surfaces of the dielectric resonant elements 2A to 2D. The plate-shaped circuit element 4 is a flat board having a rectangular upper surface and a rectangular lower surface and extends lengthwise from the left side surface to the right side surface. The plate-shaped circuit element 4 includes a low dielectric-constant plate 41, top electrodes 42A, 42B, 42C, and 42D, and bottom electrodes 43A and 43B.

The low dielectric-constant plate 41 is made of a material such as LTCC or glass epoxy and is a flat board having a rectangular upper surface and a rectangular lower surface. The top electrodes 42A to 42D are disposed on the upper surface of the low dielectric-constant plate 41 and arranged in order from the left side surface side to the right side surface side. The top electrode 42A is coupled to the tongue portion 32 of the terminal 3A by a coupling method such as soldering. The top electrode 42B is coupled to the tongue portion 32 of the terminal 3B by a coupling method such as soldering. The top electrode 42C is coupled to the tongue portion 32 of the terminal 3C by a coupling method such as soldering. The top electrode 42D is coupled to the tongue portion 32 of the terminal 3D by a coupling method such as soldering. The bottom electrodes 43A and 43B are disposed on the lower surface of the low dielectric-constant plate 41. Part of the bottom electrode 43A faces part of the top electrode 42A with the low dielectric-constant plate 41 interposed therebetween. Part of the bottom electrode 43B faces part of the top electrode 42D with the low dielectric-constant plate 41 interposed therebetween.

The substrate 5 functions as a mount surface of the filtering device 1. The substrate 5 includes a board portion 51, connecting electrodes 52A and 52B, and earth electrodes 53. The board portion 51 is a substantially square flat board made of a material such as glass epoxy. The connecting electrode 52A is disposed so as to extend from a portion of the upper surface to a portion the lower surface via the left side surface of the board portion 51. The connecting electrode 52B is disposed so as to extend from a portion of the upper surface to a portion of the lower surface via the right side surface of the board portion 51. The earth electrodes 53 are disposed on the upper surface and the lower surface of the board portion 51. Although not illustrated, the earth electrode 53 on the lower surface of the board portion 51 extends to the front-surface-side end portion of an area interposed between the connecting electrode 52A and the connecting electrode 52B.

The connecting electrode 52A is coupled to the bottom electrode 43A of the plate-shaped circuit element 4 by a coupling method such as soldering. The connecting electrode 52B is coupled to the bottom electrode 43B of the plate-shaped circuit element 4 by a coupling method such as soldering. The earth electrodes 53 of the substrate 5 are coupled to the outer conductors 22 of the dielectric resonant elements 2A to 2D by a coupling method such as soldering.

The shield member 6 is disposed over the upper surface of the substrate 5 so as to cover the dielectric resonant elements 2A to 2D. The shield member 6 is made of an electrically conductive material such as metal. The shield member 6 includes a front surface board 61, an upper surface board 62, and side surface boards 63A and 63B.

The front surface board 61 is fixed to the substrate 5 at its lower end portion. The front surface board 61 faces the front surfaces of the dielectric resonant elements 2A to 2D, the terminals 3A to 3D, and the plate-shaped circuit element 4 at its upper end portion. The upper surface board 62 extends at an angle from the upper end portion of the front surface board 61 toward the back surface side. The upper surface board 62 faces the upper surfaces of the terminals 3A to 3D, the plate-shaped circuit element 4, and front-surface-side end portions of the dielectric resonant elements 2A to 2D. Back-surface-side end portions of the dielectric resonant elements 2A to 2D protrude beyond the upper surface board 62 toward the back surface side. The back-surface-side end portion of the upper surface board 62 is coupled to the outer conductors 22 on the upper surfaces of the dielectric resonant elements 2A to 2D by a coupling method such as soldering. The side surface boards 63A and 63B extend downward at an angle from respective left-side-surface-side and right-side-surface-side end portions of the upper surface board 62. The side surface boards 63A and 63B respectively face the outer side surfaces of the dielectric resonant elements 2A and 2D. Lower end portions of the side surface boards 63A and 63B are respectively coupled to the outer conductors 22 on the outer side surfaces of the dielectric resonant elements 2A and 2D by a coupling method such as soldering.

The upper surface board 62 of the shield member 6 has cavities 64A and 64B. Front-surface-side end portions of the upper surfaces of the dielectric resonant elements 2A and 2B and the terminals 3A and 3B are exposed through the cavity 64A to the upper surface side of the shield member 6. Front-surface-side end portions of the upper surfaces of the dielectric resonant elements 2C and 2D and the terminals 3C and 3D are exposed through the cavity 64B to the upper surface side of the shield member 6. Back end portions of the dielectric resonant elements 2A to 2D are exposed to the back surface side of the shield member 6.

Figure 3:
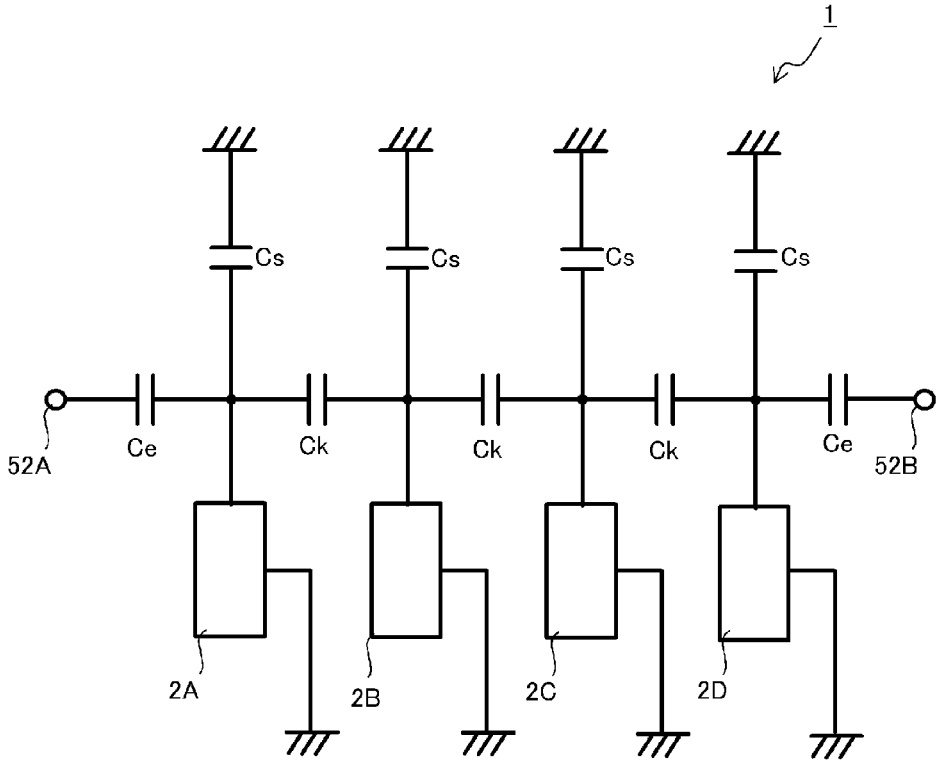
FIG. 3 is an equivalent circuit diagram of the filtering device according to the first embodiment.

FIG. 3 is an equivalent circuit diagram of the filtering device 1 according to the first embodiment.

As described above, each of the dielectric resonant elements 2A to 2D has electrode-free portions 25 and 26. Thus, the inner conductor 23 is open at both ends. Thus, each of the dielectric resonant elements 2A to 2D constitutes a single λ/2 resonator.

As described above, the top electrodes 42A to 42D of the plate-shaped circuit element 4 are adjacent to one another. Thus, an electrostatic capacity Ck occurs between each adjacent two of the top electrodes 42A to 42D. As described above, the bottom electrode 43A and the top electrode 42A of the plate-shaped circuit element 4 face each other with the low dielectric-constant plate 41 interposed therebetween. The bottom electrode 43B and the top electrode 42D also face each other with the low dielectric-constant plate 41 interposed therebetween. Thus, electrostatic capacities Ce occur between the bottom electrode 43A and the top electrode 42A and between the bottom electrode 43B and the top electrode 42D. As described above, the earth electrode 53 of the substrate 5 on the back surface extends to a portion interposed between the connecting electrodes 52A and 52B. Thus, the earth electrode 53 of the substrate 5 on the back surface faces the top electrodes 42A to 42D of the plate-shaped circuit element 4 with the substrate 5 and the low dielectric-constant plate 41 interposed therebetween. Thus, an electrostatic capacity Cs occurs between the earth electrode 53 of the substrate 5 on the back surface and each of the top electrodes 42A to 42D of the plate-shaped circuit element 4.

The λ/2 resonator constituted by the dielectric resonant element 2A is coupled to the connecting electrode 52A via the electrostatic capacity Ce. The λ/2 resonator constituted by the dielectric resonant element 2D is coupled to the connecting electrode 52B via the electrostatic capacity Ce. Adjacent two of the λ/2 resonators constituted by the dielectric resonant elements 2A to 2D are coupled to each other via the electrostatic capacity Ck. The λ/2 resonators constituted by the dielectric resonant elements 2A to 2D are each grounded via the electrostatic capacities Cs. The filtering device 1 has such an equivalent circuit configuration and has band pass filter characteristics.

In the filtering device 1 having the above-described configuration, the plate-shaped circuit element 4 forms the electrostatic capacities Ck, Ce, and Cs and the plate-shaped circuit element 4 is connected to the dielectric resonant elements 2A to 2D using the terminals 3A to 3D. Thus, the electrostatic capacities Ck, Ce, and Cs can be appropriately determined independent from the dielectric resonant elements 2A to 2D. This configuration facilitates setting of desirable filter characteristics of the filtering device 1, whereby the filtering device 1 can be designed more flexibly. Since each of the dielectric resonant elements 2A to 2D constitutes a discrete resonant element having a single-pair configuration, the resonance frequency for a TE mode that occurs in each of the dielectric resonant elements 2A to 2D is separated from the pass band of the filtering device 1, whereby the band pass filter characteristics are less likely to deteriorate.

In the filtering device 1, each of the dielectric resonant elements 2A to 2D constitutes a λ/2 resonator and is thus allowed to have a larger dielectric block 21 than in the case where each of the dielectric resonant elements 2A to 2D constitutes a λ/4 resonator. This configuration eliminates the need for significant size reduction of the dielectric resonant elements 2A to 2D and the plate-shaped circuit element 4 for the case where the filtering device 1 is adapted for a frequency band higher than the frequency band used thus far. Thus, the dielectric resonant elements 2A to 2D and the plate-shaped circuit element 4 can be formed in feasible sizes, whereby the filtering device 1 adapted to a frequency band higher than the frequency band used thus far can be easily formed.

FIG. 4A is a table of the values of the electrostatic capacity Ce and the electrostatic capacity Ck required to attain desired filter characteristics in an example case where the filtering device 1 is adapted for the 5.0-GHz band. The electrostatic capacity Ce that attains external coupling was 0.167 pF in the example case where each dielectric resonant element constitutes a λ/2 resonator, as in the case of the embodiment. On the other hand, in a comparative example where each dielectric resonant element constitutes a λ/4 resonator, the electrostatic capacity Ce was 0.150 pF. The electrostatic capacity Ck that attains coupling between resonators was 0.202 pF in the example where each dielectric resonant element constitutes a λ/2 resonator. On the other hand, in the comparative example where each dielectric resonant element constitutes a λ/4 resonator, the electrostatic capacity Ck was 0.117 pF. In this manner, in the example case where the filtering device 1 is adapted for the 5.0-GHz band, it was found that each dielectric resonant element is more likely to require a larger electrostatic capacity Ce and a larger electrostatic capacity Ck in the case where the dielectric resonant element constitutes a λ/2 resonator than in the case where the dielectric resonant element constitutes a λ/4 resonator. Thus, the filtering device 1 according to the embodiment has larger electrostatic capacities Ce and Ck that are to be formed in the plate-shaped circuit element 4 and the filtering device 1 is less likely to require significant design changes such as miniaturization of electrode areas or use of special materials even when adapted for a high frequency band such as a 5.0-GHz band.

In the filtering device 1, the inner conductor 23 and the outer conductor 22 are completely separated from each other in each of the dielectric resonant elements 2A to 2D constituting a λ/2 resonator. Thus, electric currents negligibly concentrate in the outer conductor 22, whereby the Q factor does not deteriorate.

FIG. 4B is a graph of the Q factor of the dielectric resonant element in an example case where the filtering device 1 is adapted for a 5.0-GHz band. The Q factor of the dielectric resonant element was approximately 650 throughout the entire 5.0-GHz band in the example case where each dielectric resonant element constitutes a λ/2 resonator, as in the case of the embodiment. On the other hand, in a comparative example where each dielectric resonant element constitutes a λ/4 resonator, the Q factor of the dielectric resonant element was approximately 500 throughout the entire 5.0-GHz band. In this manner, in the example case where the filtering device 1 is adapted for the 5.0-GHz band, it was found that each dielectric resonant element is more likely to have a larger Q factor in the case where the dielectric resonant element constitutes a λ/2 resonator than in the case where the dielectric resonant element constitutes a λ/4 resonator. Thus, in the filtering device 1 according to the embodiment in which the dielectric resonant elements 2A to 2D constitute λ/2 resonators, it is found that the dielectric resonant elements 2A to 2D are allowed to have an improved Q factor.

Besides, in the filtering device 1, the shield member 6 covers the front surfaces of the dielectric resonant elements 2A to 2D. The front surfaces of the dielectric resonant elements 2A to 2D are thus resistant to external influences although the electrode-free portions 25 extend over the entire front surfaces of the dielectric resonant elements 2A to 2D. The dielectric resonant elements 2A to 2D each have an electrode-free portion 26 on its back surface side and constitute a λ/2 resonator. However, the back surfaces of the dielectric resonant elements 2A to 2D are resistant to external influences since they are covered with the outer conductors 22.

FIG. 4C is a graph of the amount of change in insertion loss when an external metal is brought close to the back surfaces of the dielectric resonant elements in an example case where the filtering device 1 is adapted for the 5.0-GHz band. In the example case where the entire back surfaces of the dielectric resonant elements are covered with outer conductors as in the case of the embodiment, the insertion loss of the dielectric resonant elements remained stable regardless of the distance between the external metal and the dielectric resonant elements and the amount of change in insertion loss did not exceed 0.05 dB even when the external metal was brought extremely close to the back surfaces. On the other hand, in a comparative example where electrode-free portions extend over the entire back surfaces of the dielectric resonant elements, the insertion loss of the dielectric resonant elements became unstable when the external metal was brought extremely close to the back surfaces and changed by an amount of approximately 0.35 dB. As described above, it is found that the insertion loss of the dielectric resonant elements remains more stable against an approach of an external metal in the example case where the entire back surfaces of the dielectric resonant elements are covered with outer conductors than in the case where the entire back surfaces of the dielectric resonant elements are electrode-free portions. Thus, the filtering device 1 according to the embodiment is also resistant to external influences since the back surfaces of the dielectric resonant elements 2A to 2D are covered with the outer conductors 22. Here, an example assumed as the external metal is a shield case of a mother substrate on which the filtering device of the example is mounted.

In the filtering device 1, the dielectric resonant elements 2A to 2D can be subjected to an adjustment while the shield member 6 remains attached.

Figure 5A:
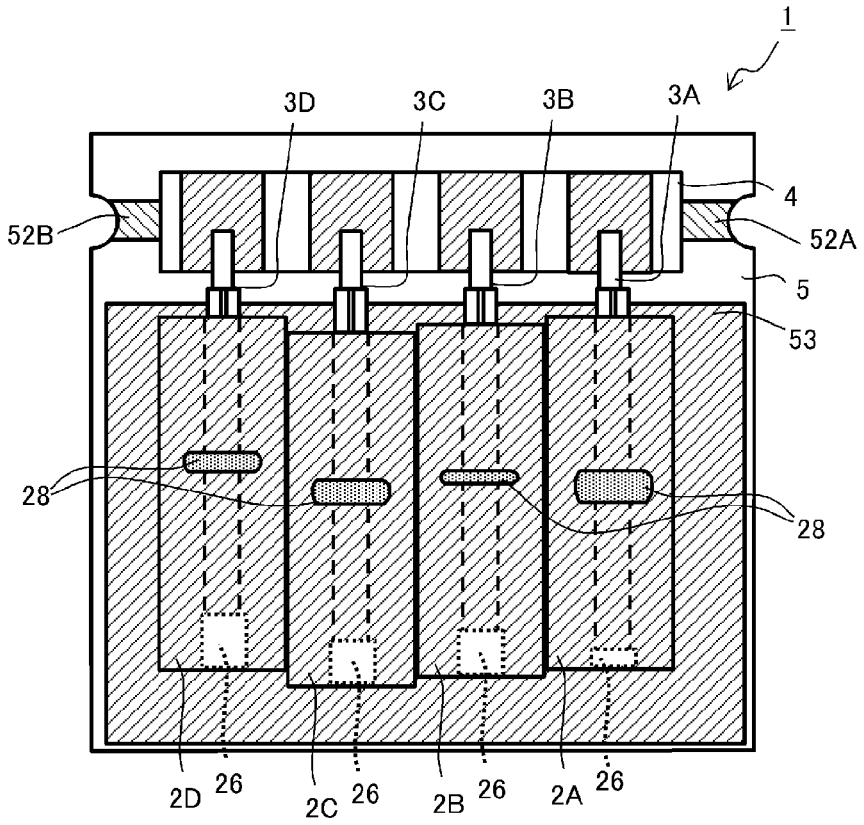
FIGS. 5A and 5B are a plan view and a back view of the filtering device according to the first embodiment subjected to adjustments of its characteristics.

FIG. 5A is a partial plan view of the filtering device 1 subjected to an insertion-amount adjusting operation in which an amount by which the terminals 3A to 3D are inserted into the respective dielectric resonant elements 2A to 2D is adjusted, an operation of adjusting the shapes of the electrode-free portions 26, and an operation of trimming the outer conductors 22 on the upper surfaces. Here, the dielectric resonant elements 2A to 2D have an equal length and the amount by which the terminals 3A to 3D are inserted into the dielectric resonant elements 2A to 2D are adjusted separately. Thus, the positions of the dielectric resonant elements 2A to 2D in the direction connecting the front surface to the back surface are different from one another. The electrode-free portions 26 of the dielectric resonant elements 2A to 2D formed in the through holes 24 are adjusted so as to have different widths and so as to be formed at different positions. Thus, the inner conductors 23 of the dielectric resonant elements 2A to 2D have different lengths.

In this manner, while the dielectric resonant elements 2A to 2D attain appropriate resonator lengths, the positions of the dielectric resonant elements 2A to 2D can be adjusted by performing an operation of adjusting the amount by which the terminals 3A to 3D are inserted into the respective dielectric resonant elements 2A to 2D and by performing an operation of adjusting the shapes of the electrode-free portions 26. Thus, the dielectric resonant elements 2A to 2D can be positioned so as to be negligibly subject to external influences even when an external metal is disposed near the back surface of the filtering device 1.

The dielectric resonant elements 2A to 2D have trimmed marks 28 obtained by partially removing the outer conductors 22 on the upper surfaces by trimming the outer conductors 22 on the upper surfaces through the cavities 64A and 64B of the shield members 6. Such trimmed marks 28 can be formed by laser processing or processing with a die grinder.

Trimming the upper surfaces of the dielectric resonant elements 2A to 2D can change the characteristics of the dielectric resonant elements 2A to 2D such as the resonator length or the degree to which resonators are coupled together. More specifically, increasing the resonator length can adjust the resonance frequency to the lower side. Thus, the filtering device 1 is allowed to have its characteristics adjusted by being subjected to trimming even after being subjected to the insertion-amount adjusting operation, in which the amount by which the terminals 3A to 3D are inserted into the respective dielectric resonant elements 2A to 2D are adjusted, or after being subjected to the operation of adjusting the shapes of the electrode-free portions 26, as described above. Thus, a desired resonator length can be obtained while undesirable factors such as production variation of the electrode-free portions 26 are compensated for, whereby the filtering device 1 can reliably have desired filter characteristics.

Figure 5B:
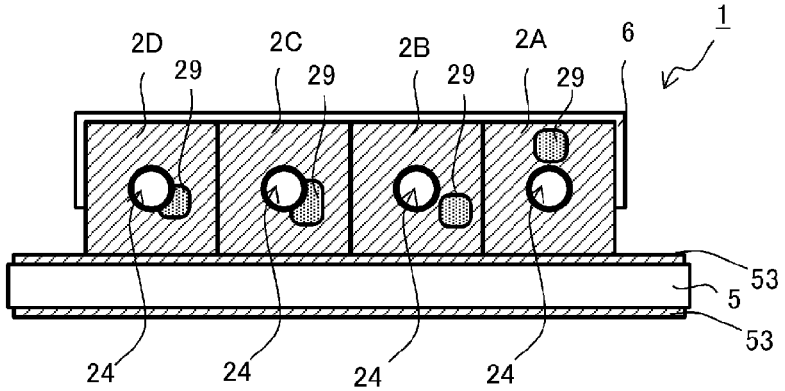

FIG. 5B is a view of the back surface of the filtering device 1 in which the back surfaces of the dielectric resonant elements 2A to 2D have been trimmed. Here, the front surfaces of the dielectric resonant elements 2A to 2D are not trimmed and only the outer conductors 22 on the back surfaces are trimmed to partially remove the outer conductors 22 on the back surfaces and form trimmed marks 29. Such trimmed marks 29 can be formed by a processing method such as laser processing, processing with a die grinder, or etching.

Merely trimming the back surfaces of the dielectric resonant elements 2A to 2D in this manner can also change the characteristics of the dielectric resonant elements 2A to 2D such as the resonator length or the degree to which resonators are coupled together. Thus, the filtering device 1 is allowed to have its characteristics adjusted by being subjected to a trimming operation on the back surface even after being subjected to the insertion-amount adjusting operation in which the amount by which the terminals 3A to 3D are inserted into the respective dielectric resonant elements 2A to 2D are adjusted, after being subjected to the operation of adjusting the shapes of the electrode-free portions 26, or after being subjected to the trimming operation on the upper surfaces of the dielectric resonant elements 2A to 2D, as described above. Thus, a desired resonator length can be obtained while undesirable factors such as production variation of the electrode-free portions 26 are compensated for, whereby the filtering device 1 can reliably have desired filter characteristics.

In the case where the upper surfaces of the dielectric resonant elements 2A to 2D are trimmed, it is preferable that the trimmed marks 28 be positioned around the intermediate position in the axial direction, for example, positioned so as to cover the middle in the axial direction. The adjustment sensitivity of the resonance frequency to the trimming operation increases as the portion that is to be trimmed is located closer to the middle in the axial direction, whereas the adjustment sensitivity of the resonance frequency to the trimming operation decreases as the portion that is to be trimmed is located farther from the middle in the axial direction. Thus, the upper surfaces of the dielectric resonant elements 2A to 2D are trimmed so that the resonance frequencies are roughly adjusted and then the back surfaces of the dielectric resonant elements 2A to 2D are trimmed so that the resonance frequencies are finely adjusted. In this manner, the resonance frequencies can be adjusted highly accurately.

In the case where the front surfaces or the upper surfaces of the dielectric resonant elements 2A to 2D are not trimmed, the shield member 6 does not necessarily have to have the cavities 64A and 64B. The shield member 6 without the cavities 64A and 64B can become more resistant to external influences on the front surface side of the filtering device 1.

Second Embodiment

Figure 6:
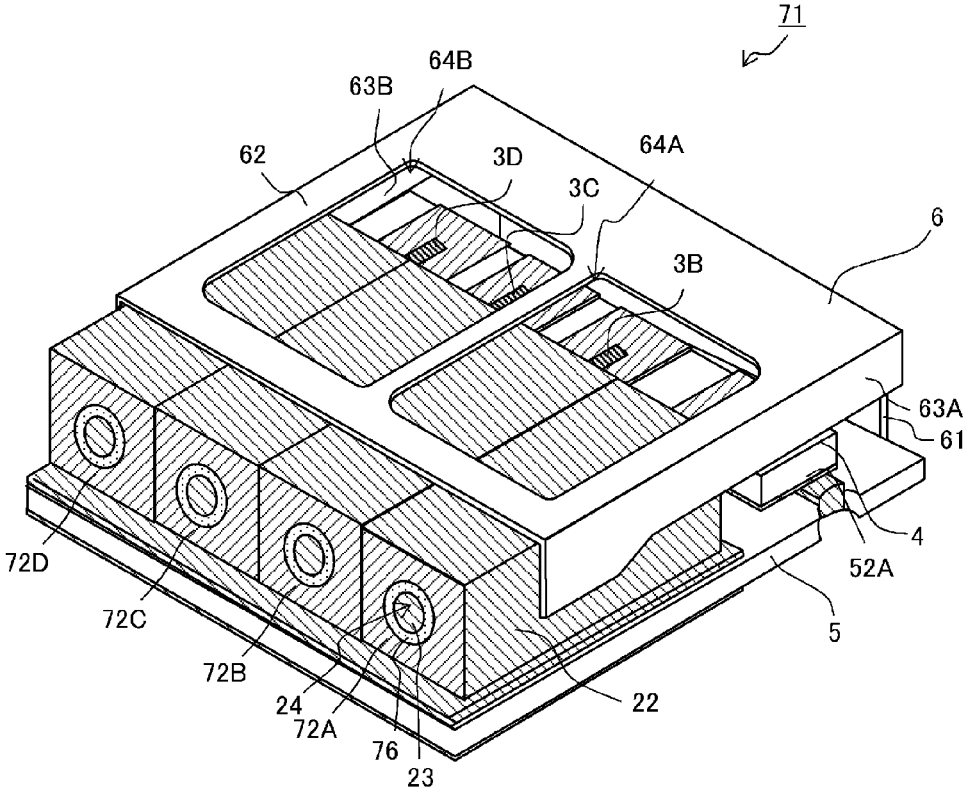
FIG. 6 is an external perspective view of a filtering device according to a second embodiment when viewed from the back surface.

FIG. 6 is an external perspective view of a filtering device 71 according to a second embodiment of the invention when viewed from the back surface. The filtering device 71 according to the second embodiment has almost the same configuration as the filtering device 1 according to the first embodiment but is different from the filtering device 1 according to the first embodiment in that it includes dielectric resonant elements 72A, 72B, 72C, and 72D. The dielectric resonant elements 72A to 72D have almost the same configuration as the dielectric resonant elements 2A to 2D according to the first embodiment but are different from the dielectric resonant elements 2A to 2D according to the first embodiment in that they each include a second electrode-free portion 76. The second electrode-free portion 76 is formed on the back surface of each dielectric block 21 around the through hole 24 without being spaced apart from the through hole 24 to separate the inner conductor 23 and the outer conductor 22 from each other. Even in this configuration, the filtering device 71 can become resistant to external influences on the back surfaces of the dielectric resonant elements 72A to 72D provided that approximately 50% or more in surface ratio of the back surfaces of the dielectric resonant elements 72A to 72D is covered with the outer conductors 22. In addition, since the electrode-free portions are exposed through the back surfaces of the dielectric blocks 21, the shapes or the positions of the electrode-free portions can be easily adjusted.

Third Embodiment

Figure 7:
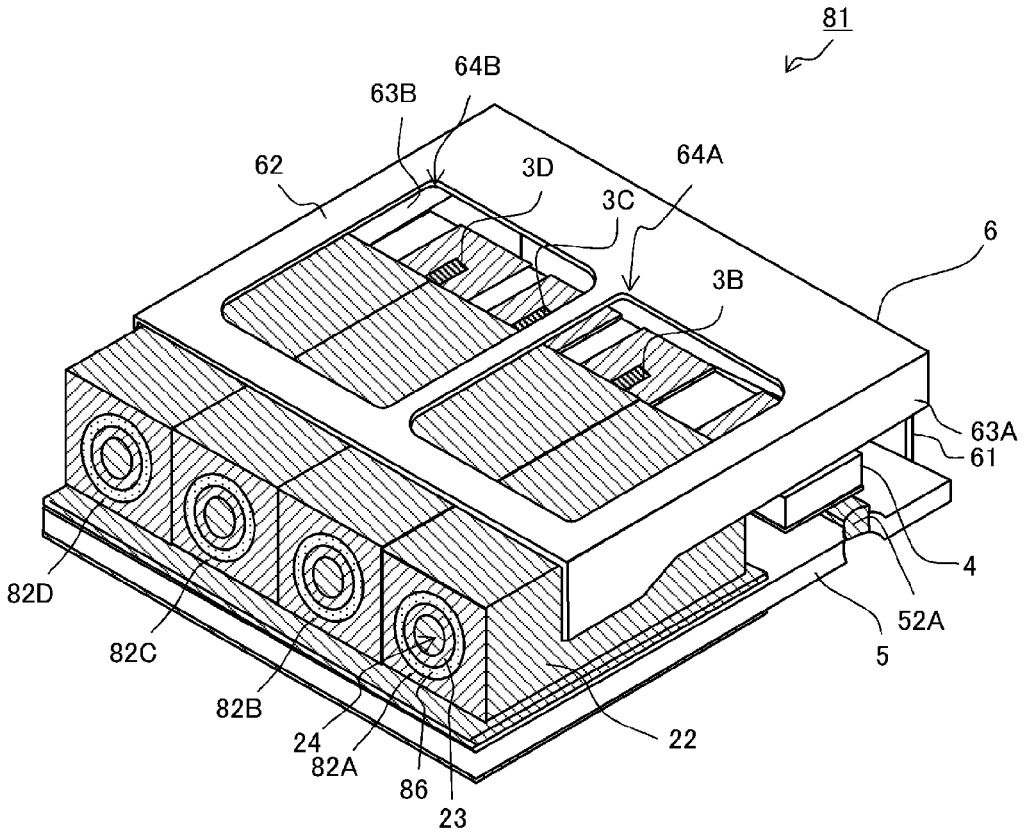
FIG. 7 is an external perspective view of a filtering device according to a third embodiment when viewed from the back surface.

FIG. 7 is an external perspective view of a filtering device 81 according to a third embodiment of the invention when viewed from the back surface. The filtering device 81 according to the third embodiment has almost the same configuration as the filtering device 1 according to the first embodiment but is different from the filtering device 1 according to the first embodiment in that it includes dielectric resonant elements 82A, 82B, 82C, and 82D. The dielectric resonant elements 82A to 82D have almost the same configuration as the dielectric resonant elements 2A to 2D according to the first embodiment but are different from the dielectric resonant elements 2A to 2D according to the first embodiment in that they each include a second electrode-free portion 86. The second electrode-free portion 86 is formed on the back surface of each dielectric block 21 around the through hole 24 while being spaced apart from the through hole 24 to separate the inner conductor 23 and the outer conductor 22 from each other. Even in this configuration, the filtering device 71 can become resistant to external influences on the back surfaces of the dielectric resonant elements 82A to 82D provided that approximately 50% or more in surface ratio of the back surfaces of the dielectric resonant elements 82A to 82D is covered with the outer conductors 22. In addition, since the electrode-free portions are exposed through the back surfaces of the dielectric blocks 21, the shapes or the positions of the electrode-free portions can be easily adjusted.

Fourth Embodiment

Figure 8:
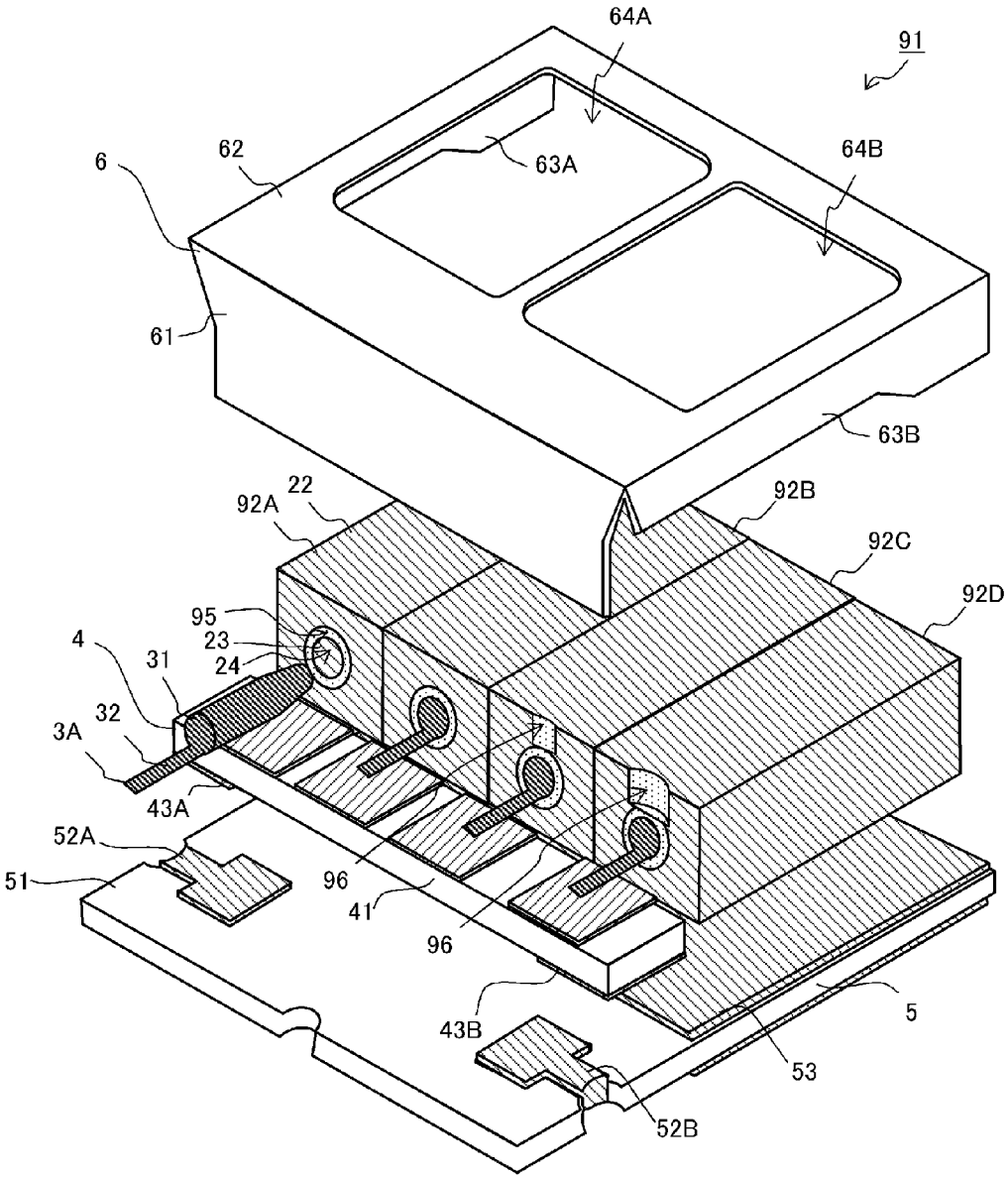
FIG. 8 is an exploded perspective view of a filtering device according to a fourth embodiment when viewed from the front surface.

FIG. 8 is an exploded perspective view of a filtering device 91 according to a fourth embodiment of the invention when viewed from the front surface. The filtering device 91 according to the fourth embodiment has almost the same configuration as the filtering device 1 according to the first embodiment but is different from the filtering device 1 according to the first embodiment in that it includes dielectric resonant elements 92A, 92B, 92C, and 92D. The dielectric resonant elements 92A to 92D have almost the same configuration as the dielectric resonant elements 2A to 2D according to the first embodiment but are different from the dielectric resonant elements 2A to 2D according to the first embodiment in that they each include a first electrode-free portion 95. The first electrode-free portion 95 is formed on the front surface of each dielectric block 21 around the through hole 24 without being spaced apart from the through hole 24 to separate the inner conductor 23 and the outer conductor 22 from each other. Part of the outer conductor 22 extends over the front surface of the dielectric block 21. In this configuration, part of the outer conductor 22 is disposed on the front surface of each of the dielectric resonant elements 92A to 92D, whereby the filtering device 91 can become resistant to external influences on the front surface of the dielectric resonant elements 92A to 92D. The characteristics of the filtering device can be adjusted using a tool such as a die grinder inserted through the cavities 64A and 64B of the shield member 6 from the front surfaces of the dielectric resonant elements 92A to 92D and by trimming the outer conductors 22 on the front surfaces of the dielectric resonant elements 92A to 92D to remove part of the outer conductors 22 and form trimmed marks 96.

In the case where the front surfaces of the dielectric resonant elements 92A to 92D are trimmed in the manner as described above, the back surfaces of the dielectric resonant elements 92A to 92D do not have to be trimmed. In this case, the trimmed marks 96 are formed on only the front surfaces of the dielectric resonant elements 92A to 92D. In this configuration, the absence of trimmed marks prevents the areas of the outer conductors 22 on the back surfaces of the dielectric resonant elements 92A to 92D from decreasing, whereby the filtering device 91 can become resistant to external influences on the back surface.

Fifth Embodiment

Figure 9:
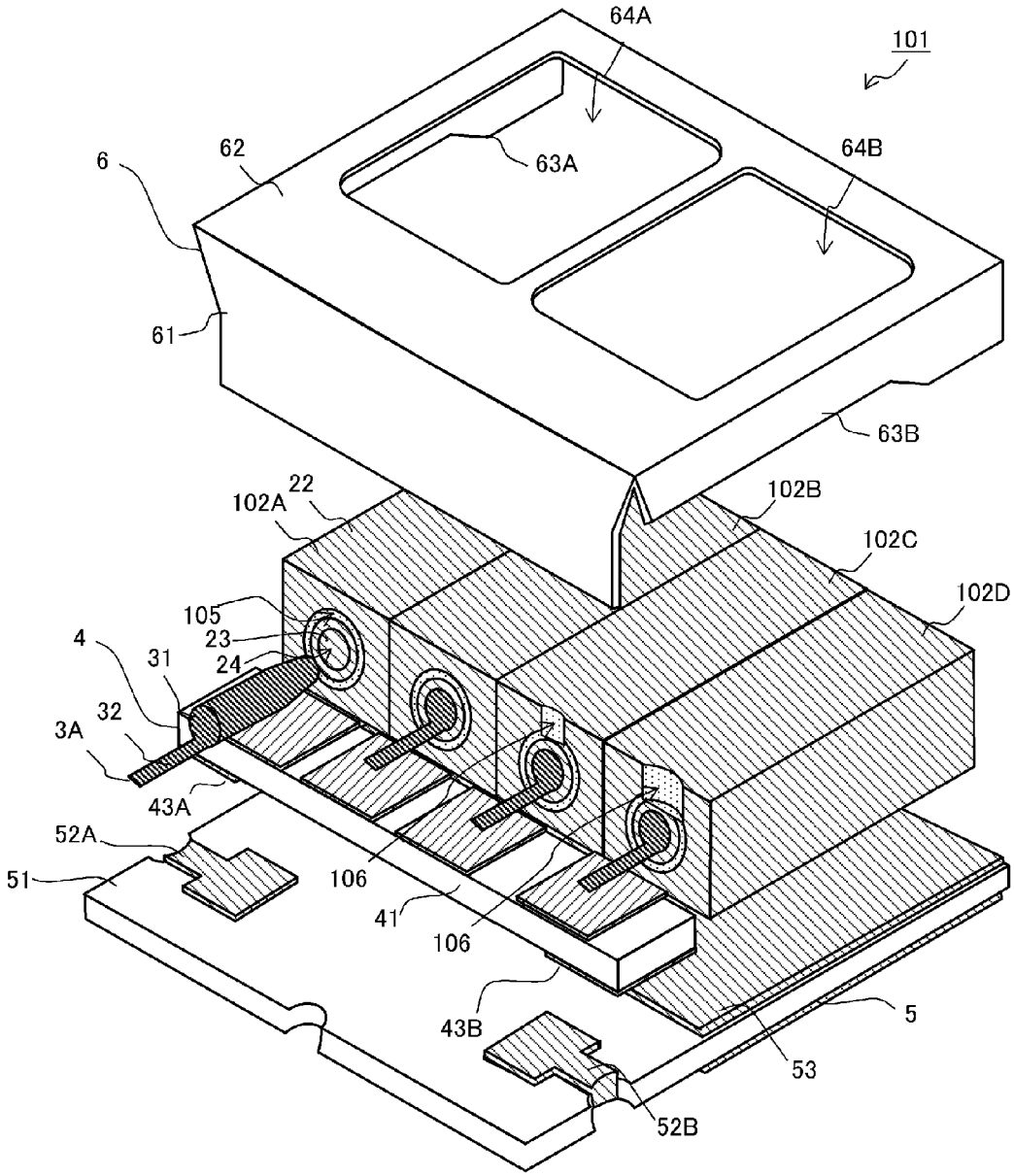
FIG. 9 is an exploded perspective view of a filtering device according to a fifth embodiment when viewed from the front surface.

FIG. 9 is an exploded perspective view of a filtering device 101 according to a fifth embodiment of the invention when viewed from the front surface. The filtering device 101 according to the fifth embodiment has almost the same configuration as the filtering device 1 according to the first embodiment but is different from the filtering device 1 according to the first embodiment in that it includes dielectric resonant elements 102A, 102B, 102C, and 102D. The dielectric resonant elements 102A to 102D have almost the same configuration as the dielectric resonant elements 2A to 2D according to the first embodiment but are different from the dielectric resonant elements 2A to 2D according to the first embodiment in that they each include a first electrode-free portion 105. The first electrode-free portion 105 is formed on the front surface of each dielectric block 21 around the through hole 24 while being spaced apart from the through hole 24 to separate the inner conductor 23 and the outer conductor 22 from each other. Even in this configuration, the filtering device 101 can become resistant to external influences on the front surfaces of the dielectric resonant elements 102A to 102D. The characteristics of the filtering device 101 can be adjusted using a tool such as a die grinder inserted through the cavities 64A and 64B of the shield member 6 from the front surfaces of the dielectric resonant elements 102A to 102D and by trimming the outer conductors 22 on the front surfaces of the dielectric resonant elements 102A to 102D to remove part of the outer conductors 22 and form trimmed marks 106.

The invention can be embodied as in the embodiments described above. Besides the embodiments described above, the invention can be embodied in various other modes. Beside a plate-shaped circuit element, an air-core coil, a square capacitor, or a chip component may be used as an example of a circuit element connected to a dielectric resonant element using a terminal. Besides a discrete resonant element having a single-pair configuration, a bulk resonant element having a multi-pair configuration may be used as an example of a dielectric resonant element. The second electrode-free portion may be continuously disposed over an area extending from the inner surface of the through hole to the back surface of the dielectric block. The shield member may be omitted. In this case, it is effective to provide part of the outer conductors also on the front surface side of the dielectric resonant elements. The shield member may cover back-surface-side end portions of the dielectric resonant elements.

While preferred embodiments of the invention have been described above, it is to be understood that variations and modifications will be apparent to those skilled in the art without departing from the scope and spirit of the invention. The scope of the invention, therefore, is to be determined solely by the following claims.

The invention claimed is:

1. A filtering device, comprising:

at least one dielectric resonant element including a dielectric block having a first end surface, a second end surface, an outer peripheral surface, and a through hole that extends from the first end surface to the second end surface, an outer conductor disposed on the outer peripheral surface and the second end surface, and an inner conductor disposed on an inner surface of the through hole;

a terminal disposed in the through hole of the at least one dielectric resonant element from the first end surface;

a circuit element electrically coupled with the at least one dielectric resonant element via the terminal;

a substrate on which the at least one dielectric resonant element and the circuit element are mounted; and a shield member configured to cover at least the first end surface of the at least one dielectric resonant element, wherein the shield member does not cover at least a portion of the second end surface of the at least one dielectric resonant element, wherein the first end surface of the dielectric block includes a first electrode-free portion that electrically isolates the inner conductor from the outer conductor, and wherein at least one of the through hole and the second end surface of the dielectric block includes a second electrode-free portion that electrically isolates the inner conductor from the outer conductor.

2. The filtering device according to claim 1, wherein at least part of the second electrode-free portion is disposed in the through hole.

3. The filtering device according to claim 1, wherein a portion of the outer conductor of the at least one dielectric resonant element is removed to form a trimmed mark that affects a filter characteristic of the filtering device.

4. The filtering device according to claim 3, wherein the trimmed mark is disposed only on the second end surface of the dielectric block.

5. The filtering device according to claim 1, wherein the shield member does not cover at least a portion of the first end surface side of the at least one dielectric resonant element.

6. The filtering device according to claim 5, wherein a portion of the outer conductor of the dielectric resonant element is removed to form a trimmed mark that affects a filter characteristic of the filtering device.

7. The filtering device according to claim 6, wherein the trimmed mark is disposed only on the first end surface of the dielectric block.

8. The filtering device according to claim 1, wherein at least a portion of the outer conductor of the at least one dielectric resonant element includes a trimmed mark that affects a filter characteristic of the filtering device.

9. The filtering device according to claim 8, wherein the trimmed mark is positioned in the outer peripheral surface between the first end surface and the second end surface of the dielectric block.

10. The filtering device according to claim 1, wherein the circuit element includes a plate-shaped circuit element that is in contact with the terminal and the substrate and that has a thickness substantially equal to a distance between the terminal and the substrate.

11. The filtering device according to claim 1, wherein the at least one dielectric resonant element includes only one pair of the through hole and the inner conductor.

12. A method for adjusting filter characteristics of a filter device having a plurality of dielectric resonant elements each including a dielectric block having a first end surface, a second end surface, an outer peripheral surface, and a through hole that extends from the first end surface to the second end surface, an outer conductor disposed on the outer peripheral surface and the second end surface, and an inner conductor disposed on an inner surface of the through hole, the method comprising:

inserting respective terminals into the respective through hole of the plurality of dielectric resonant elements from the respective first end surfaces, such that at least one of the terminals is inserted a different distance than another of the terminals;

forming a first electrode-free portion on the first end surface of the dielectric block of each of the plurality of dielectric resonant elements that electrically isolates the inner conductor from the outer conductor; and forming a second electrode-free portion one at least one of the through hole and the second end surface of the dielectric block of each of the plurality of dielectric resonant elements that electrically isolates the inner conductor from the outer conductor, such that a shape of at least one of the second electrode-free portions terminals is a different shape than another of the second electrode-free portions.

13. The method for adjusting filter characteristics of a filter device according to claim 12, further comprising trimming at least one of the first end surface and the second end surface of the dielectric resonant element to adjust a filter characteristic of the filtering device.

14. A filtering device, comprising:

a plurality of dielectric resonant elements, each including a dielectric block having a first end surface, a second end surface, an outer peripheral surface, and a through hole that extends from the first end surface to the second end surface, an outer conductor disposed on the outer peripheral surface and the second end surface, and an inner conductor disposed on an inner surface of the through hole;

a plurality of terminals disposed, respectively, in the through holes of the plurality of dielectric resonant elements from the respective first end surfaces;

a circuit element electrically coupled with the plurality of dielectric resonant elements via the plurality of terminal; and a substrate on which the plurality of dielectric resonant elements and the circuit element are mounted, wherein the first end surface of the dielectric block of each of the plurality of dielectric resonant elements includes a first electrode-free portion that electrically isolates the inner conductor from the outer conductor, wherein at least one of the through hole and the second end surface of the dielectric block of each of the plurality of dielectric resonant elements includes a second electrode-free portion that electrically isolates the inner conductor from the outer conductor, and wherein at least two of the plurality of terminals are inserted into respective through holes of two of the plurality of dielectric resonant elements, respectively, at different lengths.

15. The filtering device according to claim 14, wherein at least two second electrode-free portions of the plurality of dielectric resonant elements have a different shape with respect to each other.

16. The filtering device according to claim 14, wherein at least a portion of the outer conductor of at least one of the plurality of dielectric resonant elements includes a trimmed mark that affects a filter characteristic of the filtering device.

17. The filtering device according to claim 14, wherein the circuit element includes a plate-shaped circuit element that is in contact with the plurality of terminals and the substrate and that has a thickness substantially equal to a distance between the plurality of terminals and the substrate.

* * * * *